US006578938B2

(12) United States Patent
Norman et al.

(10) Patent No.: US 6,578,938 B2
(45) Date of Patent: Jun. 17, 2003

(54) SECURABLE TOOLCHEST WITH VISUAL-SURROUND WORKBENCH

(76) Inventors: Robert A. Norman, 8703 Antioch Rd., Salem, WI (US) 53168; William D. Hart, 817 Franklin Ave., Winthrop Harbor, IL (US) 60096

( * ) Notice: Subject to any disclaimer, the term of this patent is extended or adjusted under 35 U.S.C. 154(b) by 0 days.

(21) Appl. No.: 09/795,980

(22) Filed: Feb. 28, 2001

(65) Prior Publication Data

US 2002/0117945 A1 Aug. 29, 2002

(51) Int. Cl.[7] ..... A47B 81/00

(52) U.S. Cl. ..... 312/290; 372/249.11; 372/262; 206/373

(58) Field of Search ..... 312/289, 290, 312/902, 311, 262, 325, 315, 258, 259; 206/372, 373, 377; 269/901, 289 R; 144/285, 286.1, 286.5, 287; 108/33, 34, 35, 38

(56) References Cited

U.S. PATENT DOCUMENTS

| | | | | | |
|---|---|---|---|---|---|
| 326,810 | A | * | 9/1885 | Vandernoth | 312/290 |
| 694,312 | A | * | 2/1902 | Barber | 312/289 |
| 1,459,930 | A | | 6/1923 | Riehle | |
| 1,559,705 | A | * | 11/1925 | Jackson | 312/290 |
| 1,994,857 | A | * | 3/1935 | Krause | 312/289 |
| 2,525,208 | A | | 10/1950 | Clink | |
| 4,109,985 | A | * | 8/1978 | Lieb, Jr. | 312/289 |
| 4,383,721 | A | * | 5/1983 | Knaack et al. | 312/290 |
| 4,733,703 | A | | 3/1988 | Cimino | |
| 5,152,441 | A | * | 10/1992 | Torena | 312/902 |
| 5,207,723 | A | * | 5/1993 | Newby, Sr. | 312/290 |
| 5,215,366 | A | * | 6/1993 | Givens | 312/245 |
| 5,509,672 | A | | 4/1996 | Offerson | |
| 5,588,659 | A | | 12/1996 | Boes et al. | |
| 5,740,910 | A | * | 4/1998 | Ueng | 312/902 |
| 5,951,129 | A | * | 9/1999 | Stein | 206/373 |
| 5,967,318 | A | * | 10/1999 | Rosler | 206/372 |
| 6,039,418 | A | * | 3/2000 | Thomas | 312/262 |
| 6,082,538 | A | * | 7/2000 | Snider et al. | 206/372 |
| 6,113,202 | A | * | 9/2000 | Germano | 312/315 |

FOREIGN PATENT DOCUMENTS

| | | | | |
|---|---|---|---|---|
| DE | 373317 | * | 4/1989 | 206/373 |
| EP | 319969 | * | 6/1989 | 206/373 |
| FR | 2575957 | * | 7/1986 | 144/285 |

* cited by examiner

*Primary Examiner*—Lanna Mai
*Assistant Examiner*—Hank V. Tran
(74) *Attorney, Agent, or Firm*—Jansson, Shupe & Munger, Ltd.

(57) ABSTRACT

A combination toolchest and workbench has a base member with an upper surface, and front, back and side edges. An upright rear panel with lateral edges and a top edge, is affixed to the back edge of the base member. A pair of opposed upright side panels, each having a lower edge adjacent to one of the side edges of the base, an upper edge, a forward edge, and a rear edge, are each pivotably attached to one of the lateral edges of the rear panel. The inside surfaces of at least one of the rear and side panels have tool-holding device receptors. The combination toolchest and workbench has a top member and an openable front panel. The combination toolchest and workbench can thus present an array of tools in a securable enclosure.

17 Claims, 6 Drawing Sheets

FIG. 6
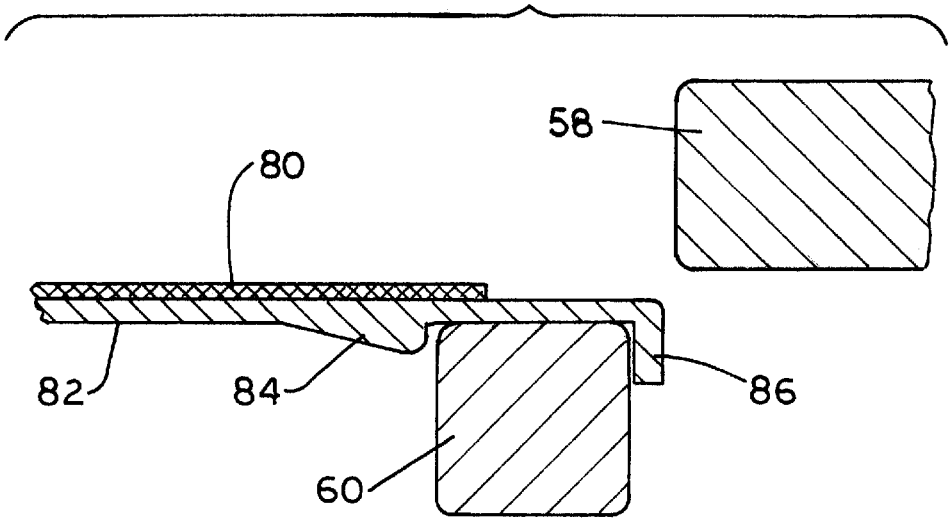
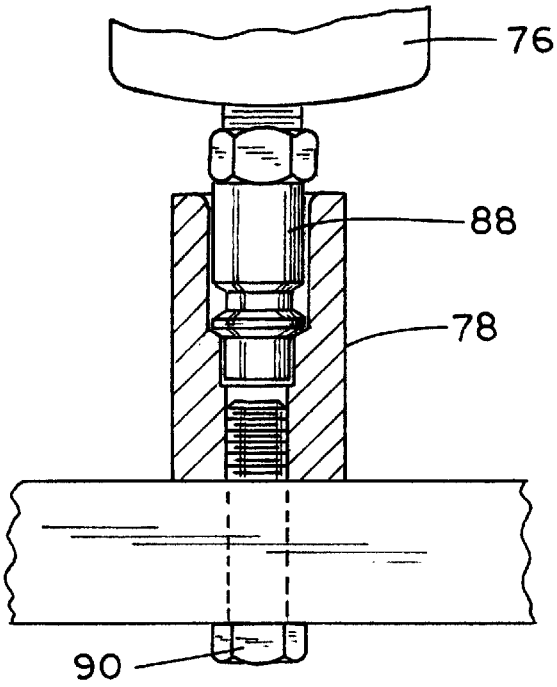
FIG. 7

SECURABLE TOOLCHEST WITH VISUAL-SURROUND WORKBENCH

FIELD OF THE INVENTION

This invention is related generally to toolchests and, more particularly, to which are toolchests which are in combination with a workbench surface.

BACKGROUND OF THE INVENTION

Professional and amateur workers have two basic needs for their hand tools: having a storage space for the tools which is secure yet accessible, and having a surface on which to work. Workbenches provide the horizontal work surface for the serious tool users.

Generally, three separate strategies are used to address the storage need: wall storage, an independent chest, or storage within the workbench. Each strategy has its relative advantages and relative drawbacks.

The wall storage is most typically exemplified by common pegboard attached to a vertical surface. Hangers engage the holes of the pegboard allowing tools, such as hammers, screwdrivers, and the like, to be suspended. Such a system has the advantage of presenting the tools in a highly visual and easily accessible array. Between use, tools may be returned to the storage location for easy retrieval when necessary. While satisfactory for the home handyperson working at a stationary base, such as at a work station in a home basement, wall storage is not portable within a larger space, nor does it provide any security.

Independent chests provide potential security and some portability, but occupy independent space—either on the workbench taking up valuable work space, or apart from the workbench thereby taking up useful floor space. Moreover, independent chests do not allow for the arrayed display of project-related tools to enhance efficiency.

Workbench storage under the work surface makes more efficient use of space, but is limited by the dimensions of the workbench as to the storage volume and size of the tools it can accommodate. Additionally, during the execution of the project, necessary tools may not be arrayed in for easy access.

Three patents have been issued to separate inventions attempting to address the problem by combining a workbench with a toolchest, U.S. Pat. Nos. 4,733,703 (Cimino), 2,525,208 (Clink), and 5,588,659 (Boes, et al.). Each are unsatisfactory solutions.

The invention of Cimino adds storage to the exterior surface of the cart below the workbench surface. While providing an additional exterior-storage surface, the invention fails to make the tools easily accessible. A worker must bend to take or return a tool. Further, to access tools, the worker must be willing and able to move around the unit. As with all understorage units, the size of the tools which the unit can accommodate is limited. Additionally, the locking procedure is cumbersome.

The Clink unit utilizes some of the advantages of a wall-storage portion, but fails to maximize its value by necessarily limiting the horizontal dimension of its wall-storage portion. Further, by effectively placing a toolchest on the surface of the workbench, the unit unsatisfactorily decreases the work surface. Even further, the pre-placement of tool holders limits the adjustability of the unit for the tools of the end user.

The invention of Boes, et al. has pivotable side racks, but lacks the flexibility of side walls. The invention also is limited in practice in size because its locking mechanism is a fitted box which must be capable of handling by an end user.

OBJECTS OF THE INVENTION

It is an object of this invention to provide an improved toolchest/workbench overcoming some of the problems and shortcomings of the prior art.

Another object of this invention is to provide securable toolchest which is easily convertible to a workbench.

Another object is to provide a toolchest/workbench that maximizes upright, back-wall surface area onto which tools may be affixed and displayed.

Still another object of the invention is to provide a toolchest/workbench that maximizes the horizontal work surface.

It is still another object of this invention to provide a workbench which is easily convertible to a toolchest within which tools may be stored and secured.

It is an object of this invention to provide a toolchest/workbench which has tool holders which are easily modified by an end user to accommodate the tools of the end user.

It is yet another object of this invention to provide pneumatic-tool holders which can hold pneumatic tools upright without the tool being coupled to the holder.

Another object of this invention is to provide a toolchest/workbench which is supported by a wheeled cart containing additional, securable tool-storage space.

These and other objects of the invention will be apparent from the following descriptions and from the drawings.

SUMMARY OF THE INVENTION

This invention is a combination toolchest/workbench. For purposes of this application, a toolchest is any device designed to contain tools within the device. This invention comprises: (a) a base member having front, back and side edges and an upper surface; (b) an upright rear panel affixed to the back edge of the base member and having lateral edges and a top edge; (c) a pair of opposed upright side panels each having a rear edge pivotably attached to one of the lateral edges of the rear panel, a lower edge adjacent to one of the side edges of the base, an upper edge, and a forward edge; (d) a top member; (e) an openable front panel; and (f) the inside surfaces of at least certain of the rear and side panels having tool-holding device receptors thereon. The tool-holding device receptors may be common peg board. The toolchest/workbench is assembled such that it presents an array of tools in an enclosure which may be secured when tools are not in use.

The combination toolchest/workbench is more useful when the front panel is pivotable with respect to the top panel. In a more preferred embodiment, the front panel is divided into two portions: an upper portion pivotable with respect to the top panel and a lower portion pivotable with respect to the upper portion.

In addition to having a front panel pivotable with respect to the top panel, the toolchest/workbench is more preferred if the top panel is pivotable with respect to the top edge of the rear panel. To help in opening the front panel and then to help in keeping the top panel in an open position, least one gas-filled chamber/piston combination can be attached with respect to the top panel and with respect to the rear panel.

To present a larger back surface onto which tools may be placed, the combination toolchest/workbench may have side panels which each independently pivot out into a rear-panel-extension position, each thereby forming an obtuse angle with respect to the rear panel. The combination toolchest/workbench is more useful when it further comprises at least one horizontal, wedge-shaped, base-extension member having a leading edge attached at about the lower edge of at least one of the side panels, and a trailing edge; then when either side panel is in the rear-panel-extension position, the respective base-extension member substantially forms a horizontal extension of the base. The base-extension members may be arranged on the side panels such that the base-extension members can be stored under the upper surface of the base member when the combination toolchest/workbench is in the closed position. A further preferred embodiment of the toolchest/workbench is the inclusion of an interlocking device attached with respect to either or both sides of the base member such that the trailing edge of the wedge-shaped base-extension members may engage and disengage the interlocking member.

Another embodiment of the invention includes the addition of a wheeled cart to support the toolchest/workbench. Such an addition raises the working surface of the workbench aspect of the invention to a useful height while at the same time making the entire unit mobile. The cart has a plurality of drawers. It is preferred that the cart has an interior storage space with a door for accessing the space and securing items within the space when the workbench is not in use. It is more preferred that the cart has at least one rack within the interior storage space which is configured for receiving tools. The rack may be a pair of rigid, parallel, spaced horizontal members whereby a plurality of tools may be suspended therebetween. It is preferable that the rack is slidably attached to the interior of the cart in order that the rack with tools may be pulled out of the interior of the cart to provide easier access to the tools on the rack.

It is preferable that the interior surface of the door be covered with a plurality of receptors set at a predetermined spacing. In this way, tool-holding devices may be repositioned from one location to multiple other locations on the interior surface of the door.

Another embodiment of the toolchest/workbench further comprises a base-member tool-holding device located on the upper surface of the base member. In one preferred embodiment, the base-member tool-holding device is capable of receiving a pneumatic tool. It is more preferred that the base-member tool-holding device has a concavity designed to mate snugly receive with a connecting end of a pneumatic tool.

Yet another embodiment of this invention comprises a locking mechanism whereby the combination toolchest/workbench may be locked in a closed position securing the contents inside when the workbench portion of the invention is not in use.

Another aspect of this invention is a tool-holding device for supporting a tool with a pneumatic couple. This portion of the invention is a rigid shell having a cylindrical cavity dimensioned to snugly receive the male portion of the pneumatic tool and hold the tool in an upright position. The receipt of the pneumatic tool, however, is without coupling. In this manner, the pneumatic tool may be removed from the non-horizontal position at which it is held by the tool-holding device without the necessity of using two hands for de-coupling.

BRIEF DESCRIPTION OF THE DRAWINGS

The drawings illustrate preferred embodiments which include the above-noted characteristics and features of the invention. The invention will be readily understood from the descriptions and drawings. In the drawings:

FIG. 6 is a partial cut-away front view of the left horizontal base-extension piece of FIG. 5.

FIG. 7 is a cross-sectional side view of the pneumatic-tool holder.

DETAILED DESCRIPTION OF PREFERRED EMBODIMENTS

Figure 1:
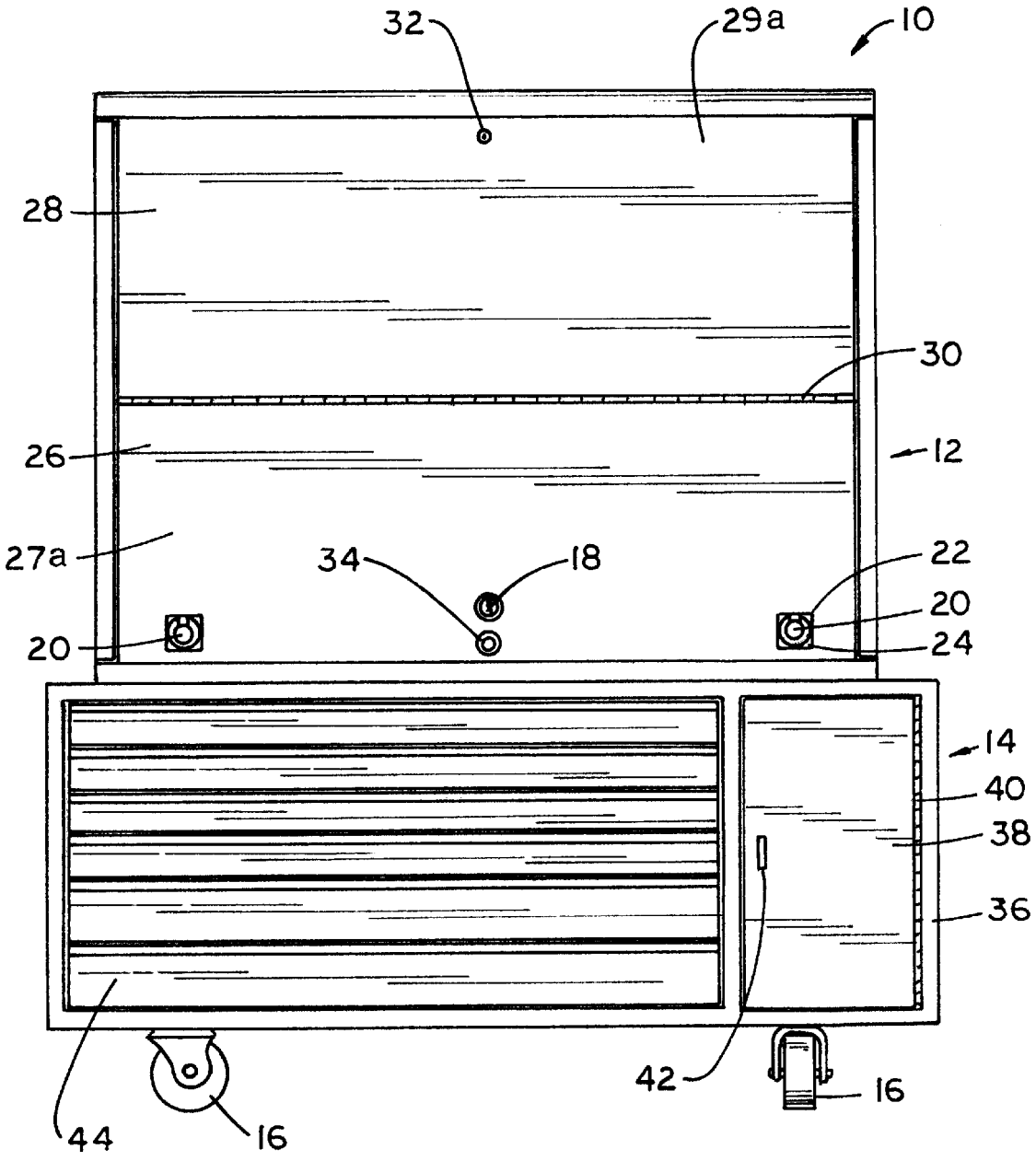
FIG. 1 is a front view of the unit in a closed position.

FIG. 1 shows a front view of the preferred embodiment of the combined tool chest/work bench 10. The combined tool chest/work bench 10 has two major parts: the upper cabinet 12 and the lower cabinet 14. Upper cabinet 12 provides convenient and secure storage of tools, provides a useful and extendable work surface, and provides a convenient array for easy access of tools when upper cabinet 12 is in a fully opened position. Lower cabinet 14 satisfies three distinct purposes: it provides mobility by means of four, single-axle casters 16, it provides storage for tools, and elevates the work space portion of upper unit 12 to a useful work height of approximately 33 inches. Both upper and lower cabinets, 12 and 14 respectively, may be looked or unlocked by a conveniently located keyhole 18. As shown, upper cabinet 12 and lower cabinet 14 are in a closed or secure position.

Two panels comprise the front of the upper cabinet, an upper panel 28 and a lower panel 26. Each panel is of a dual-wall, sheet-metal construction, creating two faces to the panel, and a space between the walls thereby reducing weight. Panels 26, 28 are attached to each other through a hinge 30. Once unlocked, upper cabinet 12 is opened by means of two circular pull rings 20 located near the bottom and toward the sides of the outer face 27*a* of lower panel 26 of upper cabinet 12. The pull rings 20 have pull-ring hinges 22 for easy use. Pull rings 20 are recessed within a concave depression 24. In response to outward force on pull rings 20, lower panel 26 will rotate about hinge 30 until the outer face of lower panel 27*a* comes into near contact, parallel with the outer face of the upper panel 29*a*. The lower panel 26 is held in place as a stud 32 located on outer face of upper panel 29*a*, snaps into a complementary receptor 34 on outer face of lower panel 27*a* thereby holding two panels 26, 28 together. When a user decides to close the unit, the user can pull on the edge of lower panel 26 opposite hinge 30 and thereby gently dislodging the receptor 34 from stud 32 allowing lower panel 26 to rotate about hinge 30 back to its original, closed position.

Lower cabinet 14 as shown consists of a shell 36. A door 38 is attached to the shell 36 by a shell hinge 40. Door 38 is openable by pulling on a handle 42. In addition to a space described in FIG. 8, lower cabinet 14 provides tool storage through a series of drawers 44.

Figure 2:
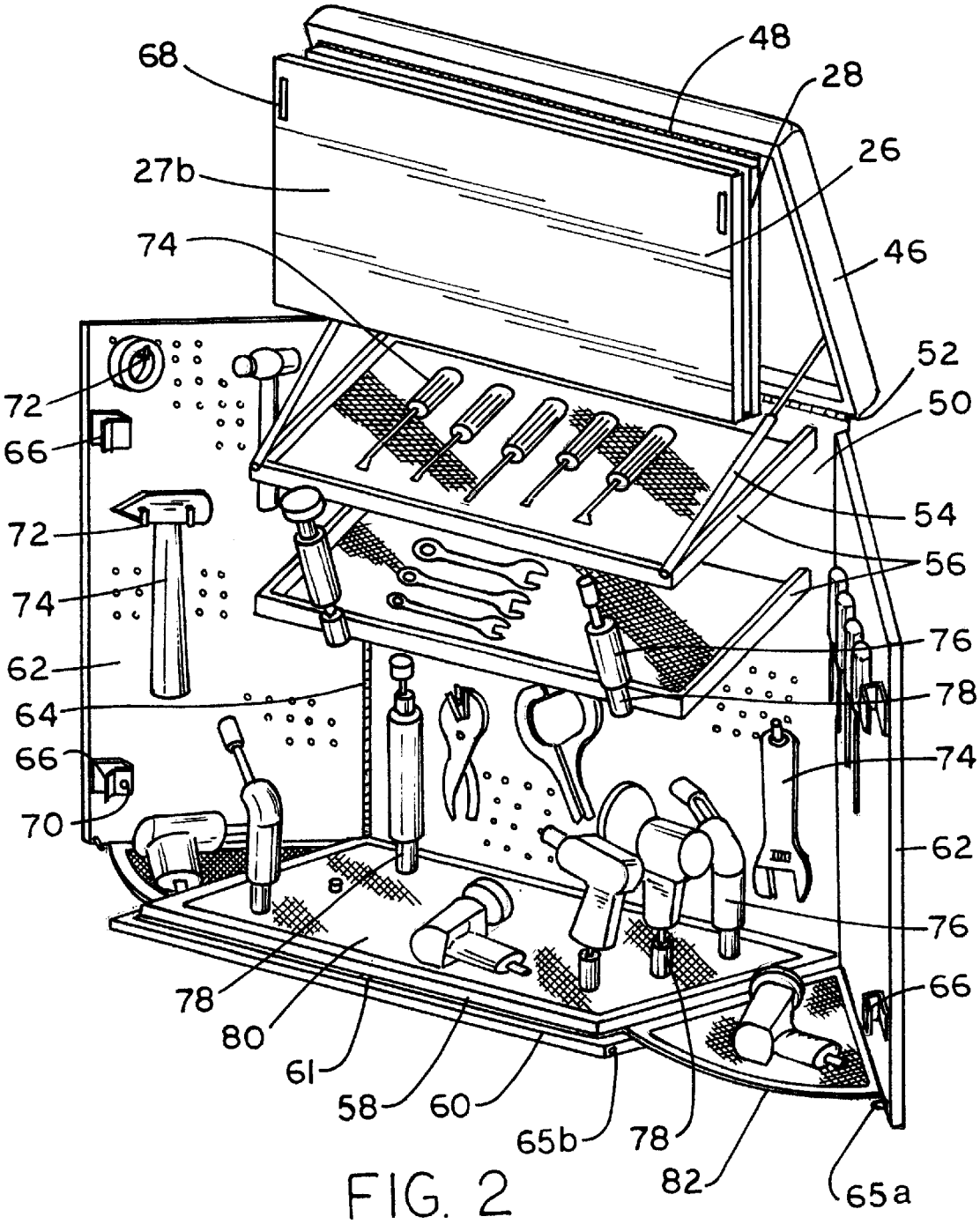
FIG. 2 is a perspective view of the upper-cabinet portion of the preferred toolchest/workbench in accordance with this invention in a fully-open position, containing tools as it could be in use.
Figure 4:
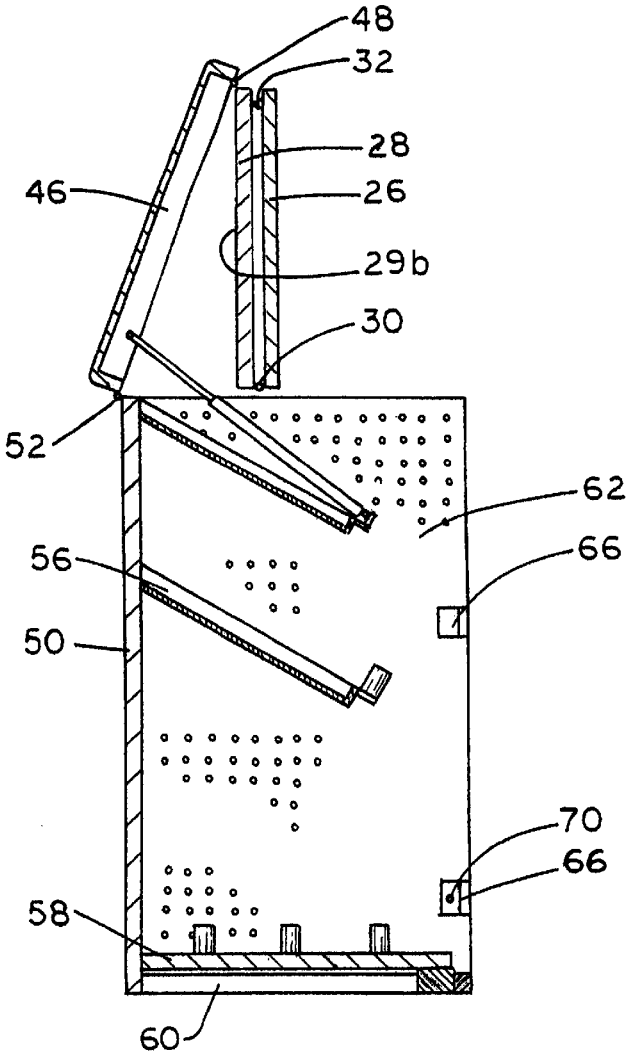
FIG. 4 is a cross-sectional side view of the upper-cabinet portion of the unit of FIG. 3.

Turning now to FIG. 2, upper cabinet 12 may be seen in a fully opened position. The top edge of upper panel 28 is attached to the lid 46 by a lid hinge 48. Lid 46 is of a single-wall, sheet-metal construction. Lid 46 is attached to the back panel 50 by a back-panel hinge 52. Back panel 50 is of a dual-wall, sheet-metal construction similar to that of upper and lower panels 26, 28. As seen in FIGS. 2 and 4, by cooperation of the hinge 30, lid hinge 48 and back-panel hinge 52, upper and lower panels 26, 28 are easily removed from the work area when the upper cabinet 12 is fully open. To hold lid 46 in its fully-opened position, two pneumatic controls 54 are provided. One end of pneumatic control 54 is attached to lid 46, the other end of the pneumatic control is attached to the front of the shelf 56. Shelf 56 is in turn fixedly attached to back panel 50 such that shelf 56 thereby provides a stationary support for the pneumatic control 54. Two shelves 56 are provided. Shelves 56 decline from back panel 50 toward the user at about a 25° angle.

The upper cabinet 12 has a base consisting of an upper base portion 58 and a lower base portion 60. The lower base portion 60 is of tubular steel construction. The tubular steel has a square cross-section. The tubes of lower base portion 60 are welded in a U-shape, with arms of equal length perpendicular to the cross piece. The cross piece is of substantially the same linear dimension as the bottom edge of the inner face of back panel 50; the arms are each of substantially the same linear dimension as the bottom edge of side panels 62. The ends of the arms of lower portion of base 60 opposite the cross piece are welded to the bottom of back panel 50, perpendicular to the inner face of back panel 50. In this manner, when lower base portion 60 sets on a horizontal surface, back panel 50 will extend vertically up from the horizontal surface.

The upper base portion 58 is a horizontal deck of heavy-gauge sheet-metal, welded perpendicularly to the inner face of back panel 50 such that the upper base portion 58 is dispensed approximately ¼ inch above the side arms of lower base portion 60. For added structural strength, upper base portion 58 is attached to the cross piece of lower base portion through a ¼ inch spacer piece 61.

Figure 3:
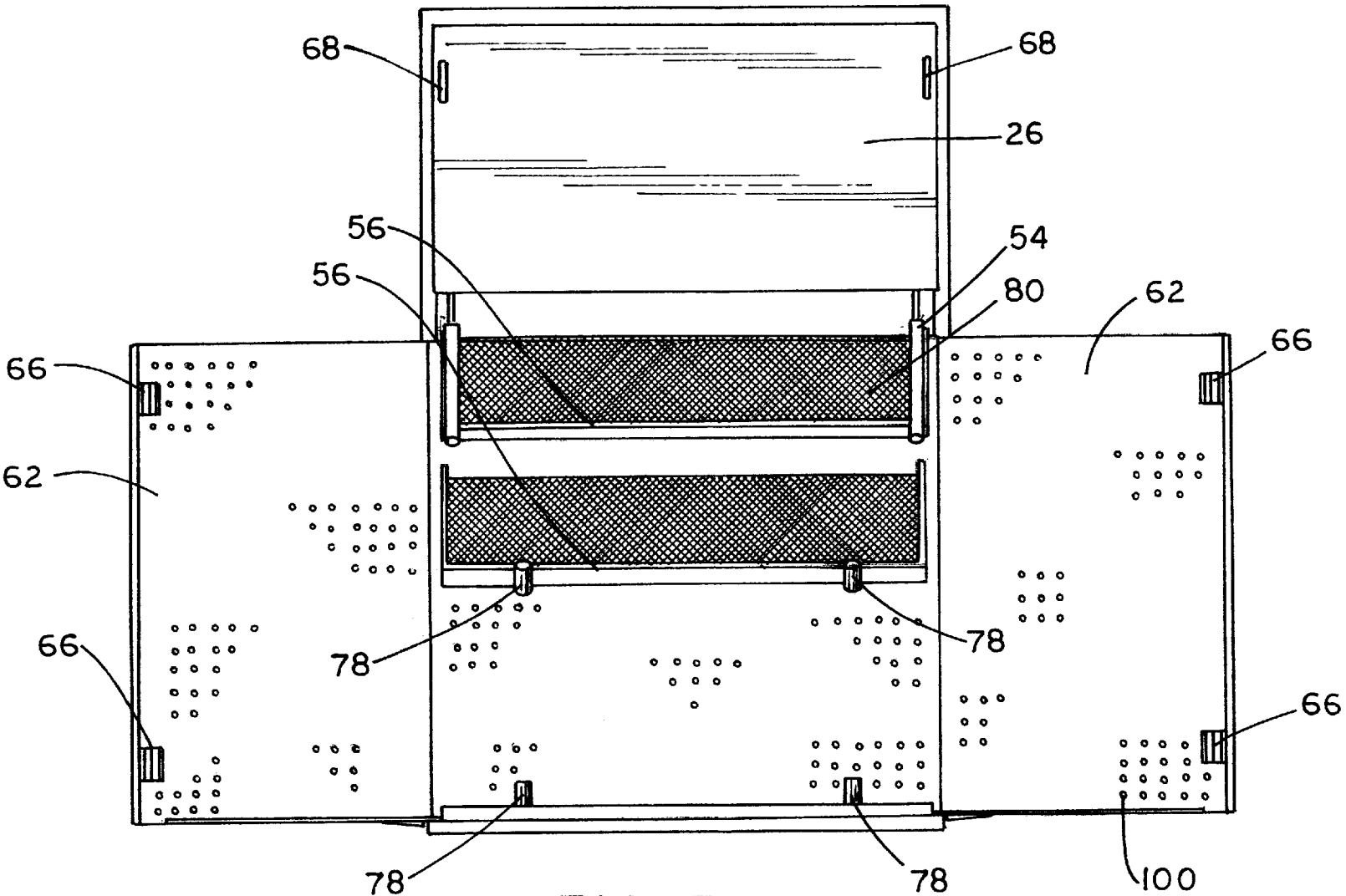
FIG. 3 is a front view of the upper portion of the unit of FIG. 1 in an open position.

From FIGS. 2 and 3, it can be seen that two side panels 62 are attached to back panel 50 by virtue of separate side-panel hinges 64. Side-panel hinges 64 allow side panels 62 to be rotated out from a start position of 90° with respect to back panel 50 to an open position of approximately 140° with respect to back panel 50. Side panels 62 are securable to the lower base portion 60 in a closed position perpendicular to back panel 50 (seen in FIGS. 1 and 4) as the side-panel-locking pin 65*a* snaps into the side-panel-locking-pin aperture 65*b* located on the outer surfaces of the arms of the of lower base portion 60

Located near the edge of each side panel 62 on the inner face, opposite side panel hinge 64 are two side latches 66. One side latch 66 is located in the upper half of side panel 62 and the other side latch 66 is located on the lower half of side panel 62. Their location is pre-determined in order to be received by latch slots 68 located on the inner face of lower panel 27*a* and the inner face of the upper panel 29*a* (latch slots 68 on the inner face of upper panel 28 are not visible on the diagrams). As each of side, upper, lower and back panels 62, 28, 26 and 50 respectively, are of a double wall sheet metal construction, a cavity is provided between the walls of each panel. Within the cavity of lower panel 26 is a locking mechanism (not shown) by which a rod may extend out from the sides of lower panel 26 to engage the lock aperture 70 found on lower side latch 66 on each of side panels 62.

For side and back panels 62 and 50, respectively, the double wall construction allows the inner wall to be perforated with a regular spacing of holes 100 thereby creating a peg board onto which standard peg board holders 72 may be placed. Non-pneumatic-type tools 74 may thus be stored in upper cabinet 12 on shelves 56 or hung on peg board holders 72. Pneumatic tools 76 may also be stored within upper cabinet 12 on pneumatic-tool holders 78 which are better seen in FIG. 7.

Shelf 56 is covered with an elastic shelf liner 80. Shelf liner 80 not only provides protection to shelf 56 from damage by tools 74, but in addition, provides a gripping surface inhibiting tools 74 from sliding down the declined shelf 56.

Immediately apparent from FIG. 4 is the cooperation of lower panel, upper panel 26 and 28, and lid 46, hinge 30, back-panel hinge 52, and lid hinge 48. Upper and lower panels 26, 28 are folded together along the hinge 30 and tacked together by stud 32 and receptor 34 (not shown). Lower panel 26 and upper panel 28 are thus removed from the work area to a position above the top edge of back panel 50.

Also apparent from this depiction is the relative gap between the upper portion of base 58 and lower portion of the base 60.

Figure 5:
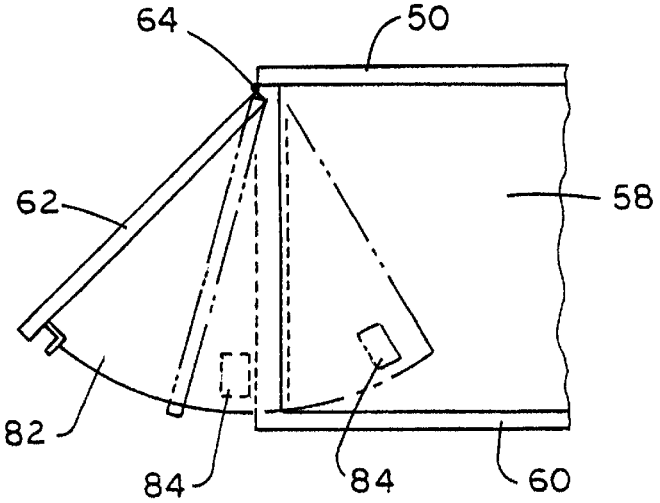
FIG. 5 is a top view of the left horizontal base-extension piece of FIG. 3.

FIGS. 5 and 6 show the base-extension wing 82. Base-extension wing 82 is a roughly pie-shaped section of sheet-metal. Base-extension wing 82 is attached along one of its linear edges to the bottom of the inner face of each side panel 62. Base-extension wing 82 is attached perpendicularly to side panel 62 and thus parallel to upper base 58. When upper cabinet 12 is in a closed position, side panel 62 is in contact with lower base 60. In the closed position, base-extension wing 82 is stored under upper base 58, between upper base portion 58 and lower base portion 60. As side panel 62 is pulled out into an open position, lower surface of base-extension wing 82 rides over the upper surface of lower base 60 until the wing lock 84 encounters the top surface of lower base 60. At that point, base-extension wing 82 is displaced upward as the inclined wing lock 84 rides up over lower base 60 until the exterior surface of lower base 60 encounters the apex of inclined wing lock 84. As side panel 62 is still further rotated out about side-panel hinge 64, wing lock 84 completes its passage over upper surface of lower base 60, and lower base 60 enters the inverse well created between wing lock 84 and base-extension-wing lip 86. Base-extension-wing lip 86 that runs along the length of the linear edge of base-extension wing 82 opposite the edge welded to side panel 62, prevents further opening of side panel 62.

To close side panel 62, base-extension wing is lifted to a point at which the lowest point of wing lock 84 is above lower base 60 and at that point side panel 62 may be rotated back in toward a closed position as wing lock 84 rides back over the top of lower base 60.

The upper surfaces of base-extension wings 82 and the upper surface of upper base 58 are covered with the non-slip shelf liner 80.

FIG. 7 shows pneumatic-tool holder 78 in more detail. Pneumatic tools 76 have particularly shaped male, pneumatic-tool couplings 88 designed to be received into a standardized fittings on air compressors. While other pneumatic-tool couplings exist which are in effect the female-receptor component found on the air compressor, these existing holders require that the pneumatic tool being held be coupled to the holder and hence when it requires two hands of a user to then de-couple the pneumatic tool from the pneumatic-tool holder. As can be seen from the present invention, pneumatic-tool holder 78 presents a cavity corresponding to the male end of the pneumatic tool coupling thereby allowing it to be inserted into the cavity of holder 78 without coupling. In this manner, the pneumatic tool may be removed in a one-handed manner by lifting the tool from holder 78. The pneumatic-tool holder 78 is placed in position on upper base 58 or as seen in FIGS. 2, 3 and 4, to lower shelf 56 by means of a bolt 90.

Figure 8:
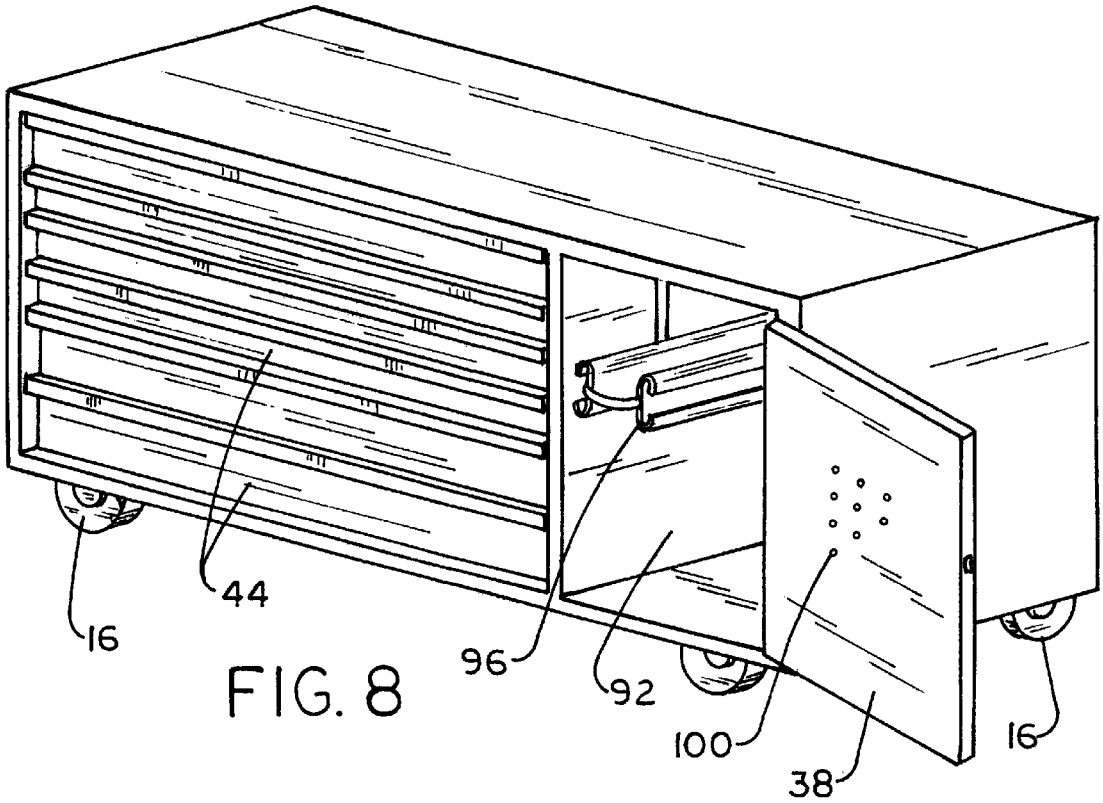
FIG. 8 is a front view of the cart portion of the unit of FIG. 1 shown in an open position.
Figure 9:
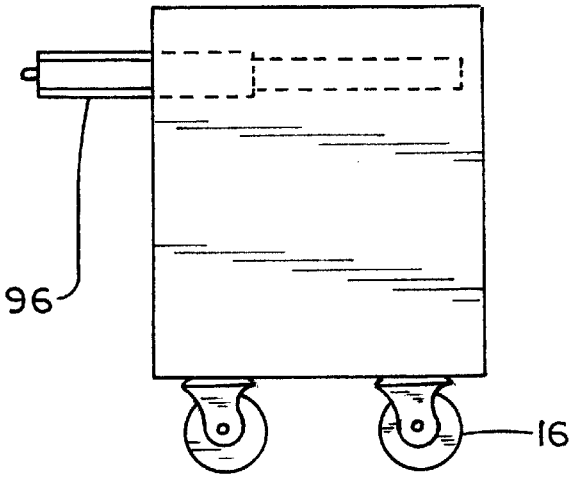
FIG. 9 is a side view of the cart portion of the unit of FIG. 8.

FIGS. 8 and 9 show lower cabinet 14 in more detail. Lower cabinet 14 is integrated with upper cabinet 12 to create the full invention. As indicated above, lower cabinet 14 provides mobility and also height at which activities may be carried out conveniently. The door 38 is attached to base 36 by hinge 40 better seen in FIG. 1. Once door 38 is opened, a compartment 92 is apparent into which tools 74 may be placed for storage. Of particular utility in storage is tool holder 96 which can slide out of lower unit 14. A longitudinal C-shaped, ball-bearing-containing member 94 has length approximating the depth of the cavity. Attached to the C-shaped member 94 is a slotted tool-holding member 96. Tools 74, such as screwdrivers or hammers, may be placed into the slotted portion of the slotted tool-holding member 96. The tool-holding member provides a large surface on which tools of a similar type but of various sizes may be organized. In a similar manner, other slidable tool holders 96 may be attached to interior of storage compartment 92, particularly the upper surface of the compartment 92, to slide out of the lower cabinet 14. Such additional slidable members are not shown. The inside surface of the door 38 is composed of a multitude of perforated holes 100 of the same dimension and spacing as the holes found on the side and back panels 62 and 50 in order that tool holder 72 may be installed at the user's discretion on the door.

A series of drawers 44 provide a substantial amount of additional securable, storage space.

While the principles of this invention have been described in connection with specific embodiments, it should be understood clearly that these descriptions are made only by way of example and are not intended to limit the scope of the invention.

What is claimed is:

1. A combination toolchest and workbench comprising:

a horizontal base member having front, back and side edges and an upper surface;

an upright rear panel affixed to the back edge of the base member and having lateral edges and a top edge;

a pair of opposed upright side panels each having a rear edge pivotably attached to one of the lateral edges of the rear panel, a lower edge adjacent to one of the side edges of the base, an upper edge, and a forward edge, wherein each side panel independently pivots out into a rear-panel-extension position, each thereby forming an obtuse angle with respect to the rear panel;

a top member;

an operable front panel pivotally attached to the top member;

the inside surfaces of at least one of the rear and side panels having tool-holding device receptors thereon; and at least one horizontal, wedge-shaped, base-extension member having a leading edge attached at about the lower edge of at least one of the side panels, and a trailing edge, such that when either side panel is in the rear-panel-extension position the base-extension member substantially forms a horizontal extension of the base, whereby the toolchest and workbench presents an array of tools in a securable enclosure.

2. The combination toolchest and workbench of claim 1 wherein the front panel is pivotable with respect to the top member.

3. The combination toolchest and workbench of claim 2 wherein the front panel has an upper portion pivotable with respect to the top member and a lower portion pivotable with respect to the upper portion.

4. The combination toolchest and workbench of claim 2 wherein the top member is pivotable with respect to the top edge of the rear panel.

5. The combination toolchest and workbench of claim 4 further comprising at least one pneumatic device attached with respect to the top member and with respect to the rear panel.

6. The combination toolchest and workbench of claim 1 configured and arranged such that the base-extension member is stored under the upper surface of the base member when the combination toolchest and workbench is in the closed position.

7. A combination toolchest and workbench comprising:

a horizontal base member having front, back and side edges and an upper surface;

an upright rear panel affixed to the back edge of the base member and having lateral edges and a top edge;

a pair of opposed upright side panels each having a rear edge pivotably attached to one of the lateral edges of the rear panel, a lower edge adjacent to one of the side edges of the base, an upper edge, and a forward edge, wherein each side panel independently pivots out into a rear-panel-extension position, each thereby forming an obtuse angle with respect to the rear panel;

a top member;

operable front panel pivotally attached to the top member;

the inside surfaces of at least one of the rear and side panels having tool-holding device receptors thereon, at least one horizontal, wedge-shaped, base-extension member having a leading edge attached at about the lower edge of at least one of the side panels, and a trailing edge, such that when either side panel is in the rear-panel-extension position the base-extension member substantially forms a horizontal extension of the base, configured and arranged such that the base-extension member is stored under the upper surface of the base member when the combination toolchest and workbench is in the closed position; and at least one interlocking device attached with respect to at least one side of the base member such that the at least one trailing edge of the at least one wedge-shaped base-extension member may engage or disengage the at least one interlocking member, whereby the toolchest and workbench presents an array of tools in a securable enclosure.

8. The combination toolchest and workbench of claim 7 further comprising a wheeled cart supporting the toolchest and workbench.

9. The combination toolchest and workbench of claim 8 wherein the cart further has a door for accessing an interior space.

10. The combination toolchest and workbench of claim 9 wherein the cart has a rack within the interior space and configured for receiving tools.

11. The combination toolchest and workbench of claim 10 wherein the rack comprises a pair of rigid, parallel, spaced horizontal members whereby a plurality of tools may be suspended therebetween.

12. The combination toolchest and workbench of claim 11 wherein the rack is slidably attached to the interior of the cart.

13. The combination toolchest and workbench of claim 10 wherein the door has an interior surface covered with a plurality of receptors set at a predetermined spacing whereby a tool-holding device may be repositioned from one location to multiple other locations on the interior surface of the door.

14. The combination toolchest and workbench of claim 7 further comprising a base-member tool-holding device located on the upper surface of the base member, the base-member tool-holding device configured to receive a pneumatic tool having a male pneumatic-tool coupling.

15. The combination toolchest and workbench of claim 14 wherein the base-member tool-holding device is capable of receiving a pneumatic tool.

16. The combination toolchest and workbench of claim 15 wherein the base-member tool-holding device has a concavity designed to mate with a connecting end of a pneumatic tool.

17. The combination toolchest and workbench of claim 7 further comprising a locking mechanism whereby the combination toolchest and workbench may be locked in a closed position.

* * * * *